US008590470B2

(12) United States Patent
Ploch

(10) Patent No.: US 8,590,470 B2
(45) Date of Patent: Nov. 26, 2013

(54) PROTECTIVE COVER KIT FOR A MARINE PROPELLER

(76) Inventor: Randal Jeffrey Ploch, St. Petersburg, FL (US)

( * ) Notice: Subject to any disclaimer, the term of this patent is extended or adjusted under 35 U.S.C. 154(b) by 343 days.

(21) Appl. No.: 13/195,288

(22) Filed: Aug. 1, 2011

(65) Prior Publication Data

US 2013/0032259 A1 Feb. 7, 2013

(51) Int. Cl.
*B63B 29/02* (2006.01)
*B63B 29/22* (2006.01)

(52) U.S. Cl.
USPC ..... 114/71

(58) Field of Classification Search
USPC ..... 114/221, 222, 361, 71, 72; 150/154
See application file for complete search history.

(56) References Cited

U.S. PATENT DOCUMENTS 5,664,975 A * 9/1997 Carlisle ..... 440/49
6,152,064 A * 11/2000 Morton ..... 114/361
6,736,686 B2 * 5/2004 Miller ..... 440/71
6,783,411 B2 * 8/2004 Pither ..... 440/71
6,916,217 B1 * 7/2005 Crepeau ..... 440/71
7,291,047 B1 * 11/2007 Jones et al. ..... 440/71
8,070,541 B2 * 12/2011 Novack, IV ..... 440/71
8,333,627 B2 * 12/2012 Novack, IV ..... 440/71
2003/0017763 A1 * 1/2003 Miller ..... 440/71
2005/0066874 A1 * 3/2005 Tonokaboni et al. ..... 114/361

* cited by examiner

*Primary Examiner* — Daniel Venne
(74) *Attorney, Agent, or Firm* — Tiffany C. Miller

(57) ABSTRACT

Provided is a protective cover kit for a marine propeller having a protective cover and a shift control warning attachment. The protective cover components have a slit and a central opening with a plurality of reliefs radiating from its circumference capable of accommodating various sized propeller hubs or shafts. Attaching elements are coupled to a slit and the first layer and second layer of the protective cover. The first and second layers are of a shape capable of substantially encasing a marine propeller. Once a force is applied by a user to the release apparatus, the attaching element is released and the protective cover is removed remotely from a distance above the surrounding water of the marine propeller. A shift control warning attachment is installed by a user onto a shift control lever to prevent inadvertent shifting prior to the removal of the propeller cover.

20 Claims, 5 Drawing Sheets

PROTECTIVE COVER KIT FOR A MARINE PROPELLER

BACKGROUND OF THE INVENTION

1. Field of the Invention

This invention relates to a protective cover kit for a marine propeller having a protective cover in which a user facilitates remote removal and having a shift control warning attachment in which a user installs to prevent inadvertent shifting prior to the removal of the protective cover. The present invention relates particularly to a protective cover having a release apparatus located thereon whereby a user applies a force to an end of the release apparatus from a distance away from protective cover thereby releasing the associated attaching element to uncover a marine propeller.

2. Background Art

An anti-fouling protective cover is placed around a marine propeller to prevent barnacle growth and to prevent other contaminants or organisms from coming into contact with a propeller. Formerly, protective covers are seen to incorporate excess parts including pockets, pairs of sleeves, and stiffening members as described in U.S. Pat. No. 5,964,174.

Thus, there is a need for a protective cover with an improved attaching method whereby eliminating the need for additional parts, stiffening members, pairs of sleeves, pockets, and eliminating the associated costs for manufacturing these parts.

Prior art propeller covers are seen to incorporate a hinge with a latch and an eyelet as a method of locking the protective cover at the site of the marine propeller unit as described in U.S. Pat. No. 5,246,345. This requires that the respective parts be disassembled by the user at the site of the marine propeller to facilitate the protective cover removal. In addition, the locking assembly may fail, rendering the protective cover inoperable.

There are several drawbacks to removing a protective cover at the site of a marine propeller. The most obvious drawback is a user being exposed to the surrounding water while releasing the attaching element of the protective cover of a submerged propeller. A second disadvantage is a user manually facilitating release of the protective cover's attaching element. This makes the removal of the protective cover more difficult and increases the time required to complete the removal.

U.S. Pat. No. Des. 386,466 shows and describes a marine propeller cover having a flexible material with a central opening and a drawstring closure around the circumference of the central opening. This design is not remotely releasable from a propeller due to the absence of a release system. There is no release apparatus and there is no releasable attaching element or slit incorporated onto the protective cover to allow for a user to remove the cover without physically coming into contact with the surrounding water while the propeller is submerged. The improved remote removal eliminates the need for a user to occupy the submerged site of the marine propeller while performing the acts of releasing the protective cover from a distance above the surrounding water.

According to *Prop Pak*. 19 Jun. 2011 <http:www.proppak.com>, describes an underwater propeller cover designed to be removed from a marine propeller from above the surface of the water. This Prop Pak is described as having a propeller cover with an open end for receiving a propeller and a slit for sliding past the shaft, a clamp to secure the open end of the cover in a closed configuration, and a webbing to release the cover from the propeller from above the waterline. This propeller cover's open end requires that the fabric be gathered and secured together with an attaching bias such as a clamp. The attaching bias may fail, rendering the propeller cover inoperable. Also, the act of gathering the fabric of the propeller cover and securing it closed with a clamp is time consuming and is not effective at preventing contaminants from reaching the propellers as described below. First, a user may gather the fabric incorrectly, allowing the propeller to be exposed to water and contaminants. Next, the act of gathering the fabric does not create a tight seal to block contaminants from reaching the propeller.

Hence, there is a need for a protective cover with an attaching element such as a series of hooks and loops which will seal the protective cover and not leave any portion of the cover open. The improved attaching method will eliminate the need for additional parts such as a clamp and eliminate the extra step requiring a user to gather fabric at an open end of the cover to secure it closed.

While these devices fulfill their respective, particular objectives, there is still a need for a protective cover kit having a protective cover with an improved release apparatus facilitating remote removal of a protective cover and having a warning attachment for the shift control lever. It is problematic that a boat engine may be started before removing the propeller cover. This would cause the propeller cover to become tangled around the hub or shaft and cause the boat to become inoperable. A warning attachment is installed by a user onto the control lever to prevent unintentional shifting prior to the removal of the propeller cover.

BRIEF SUMMARY OF THE INVENTION

The long-standing but heretofore unfulfilled need for a marine propeller protective cover kit with a shift control warning attachment and a protective cover having a release apparatus adapted to remotely remove a protective cover from a marine propeller, thereby allowing the force of a user to uncover a marine propeller from a distance above the surrounding water and which also includes improvements that overcome the limitations of prior art marine propeller covers, is now met by a new, useful, and non-obvious invention.

In a first embodiment, the novel protective cover kit for a marine propeller includes a protective cover having a first layer and a second layer having substantially the same outer perimeter. The first layer is located opposite of the second layer. The first layer and second layer are coupled together with an attaching element being of a series of hooks and loops. The first layer has a central opening and a slit to receive a marine propeller. The slit opens and closes with an attaching element being of a series of hooks and loops. A release apparatus is connected by one end to the protective cover, and is remotely operated by a user when a force is applied to the opposite end of the release apparatus.

Although the preferred embodiment for the attaching element is a series of hooks and loops, the scope of this invention should not be limited to hook and loop fasteners, but should also encompass any self-attaching methods that a user could apply to attach the first layer to the second layer or to open and close the slit, such as snaps. This attaching element creates a seal, tightly interlocking the protective cover ends to a closed configuration, which prevents contaminants and organisms from reaching the propellers while underwater.

In a second embodiment, the protective cover of the first embodiment includes a central opening having a plurality of reliefs radiating from its circumference to fit varying sized propeller hubs or shafts.

In a third embodiment, the protective cover of the first embodiment includes a slit transversing from the central opening of the first layer and extends through to a corner of the first layer's outer edge.

In a fourth embodiment, the protective cover of the first embodiment includes a slit transversing from the central opening of the first layer and extends through to the central edge of the first layer.

In a fifth embodiment, the protective cover of the first embodiment includes a release apparatus including, but not limited to, a flexible or ridged length of material such as a rope, cord, chain, or rod.

In a sixth embodiment, the protective cover of the first embodiment includes a variety of sizes, as to directly correlate with the configuration of a variety of marine propellers to be applied to.

In a seventh embodiment, the protective cover of the first embodiment includes a flexible and waterproof material including, but not limited to, canvas or vinyl.

In an eighth embodiment, the protective cover of the first embodiment includes a force being applied to an end of the release apparatus by a user including, but not limited to, a vertical or horizontal force, or a diagonal force.

In a ninth embodiment, the protective cover of the first embodiment includes a release apparatus being connected to the protective cover at an end by having been sewn together or having a reinforcing eyelet for the release apparatus to attach.

These nine (9) embodiments are illustrative of the invention and are not exclusive thereof. As marine propeller protective cover manufacturers add additional or different release apparatuses, still further release mechanisms may be required in future embodiments of the invention, but all such future embodiments are within the scope of this invention.

Moreover, as mentioned earlier, each of the nine (9) illustrative embodiments of the protective cover are adapted to be remotely removed from around the propeller shaft and blade portion of many marine propellers, including a variety of differing size propeller shaft or propeller blade protrusions therein.

For example, a variety of differing sized propeller hubs or shafts are accepted by the central opening due to the plurality of reliefs radiating from its circumference. This allows for the surrounding material to conform to the circumference of the propeller hub or shaft.

More particularly, the size of the propeller blade protrusions are accommodated through the opening of the slit on the first layer of the protective cover. The larger the blade protrusions, the more an attaching element could be released to gain access to the open configuration of the protective cover between the first layer and the second layer.

In another example, the size and shape of the propeller hub, shaft, or the propeller blade protrusions are mirrored by the flexible material used for the first layer and second layer of the protective cover. Materials with flexibility form a shape capable of substantially encasing a marine propeller.

Thus, the various combination of a protective cover configured to be remotely removed from a marine propeller and the force of a user on the end of a release apparatus, will work with all currently known marine propellers and in view of this disclosure any future changes to the protective cover components can be met.

In addition to the aforesaid embodiments of the remote removal of the protective cover, the protective cover includes multiple additional improvements as well.

A first improvement is a release apparatus connected to the protective cover. The release apparatus accommodates a user's hand at one end. The user applies a force to the release apparatus, whereby releasing the attaching element coupling the slit and the first layer and second layer. This force is necessary to remotely remove the protective cover from the marine propeller. Thus, it is understood that the protective cover is remotely removed because a user does not have to be at the propeller site to remove the protective cover, but at any length of distance above the surrounding water within the scope of this invention.

A second improvement is an attaching element such a series of hooks and loops connecting the slit and the first layer and second layer. This attaching element ensures the protective cover is tightly sealed from water and other contaminants that might otherwise come into contact with the propeller.

Another improvement is the shift control warning attachment. This is installed by a user onto a shift control lever to prevent unintentional shifting prior to the removal of the propeller cover. The warning attachment can be anything that attaches to the shifter that could warn a user to remove a protective cover from a propeller before engaging the propeller drive.

A first embodiment of the warning attachment is a sleeve which covers a shift lever. The sleeve material includes, but is not limited to, canvas or vinyl. This sleeve has a warning label directing a user to remove the protective cover from the propeller before starting the boat. A piece of material connects the sleeve to the shift control. This material includes, but is not limited to, a cord, fabric, plastic, rope, or chain.

A second embodiment of the warning attachment is a warning label connected to a band of material which is placed around the shift lever. The warning label includes but is not limited to any warning signs, words, or phrases which would remind or prompt a user to remove the protective cover before engaging the propeller drive. A user would proceed to remove the protective cover from the propeller before starting the engine because the warning label will state this warning.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1A:
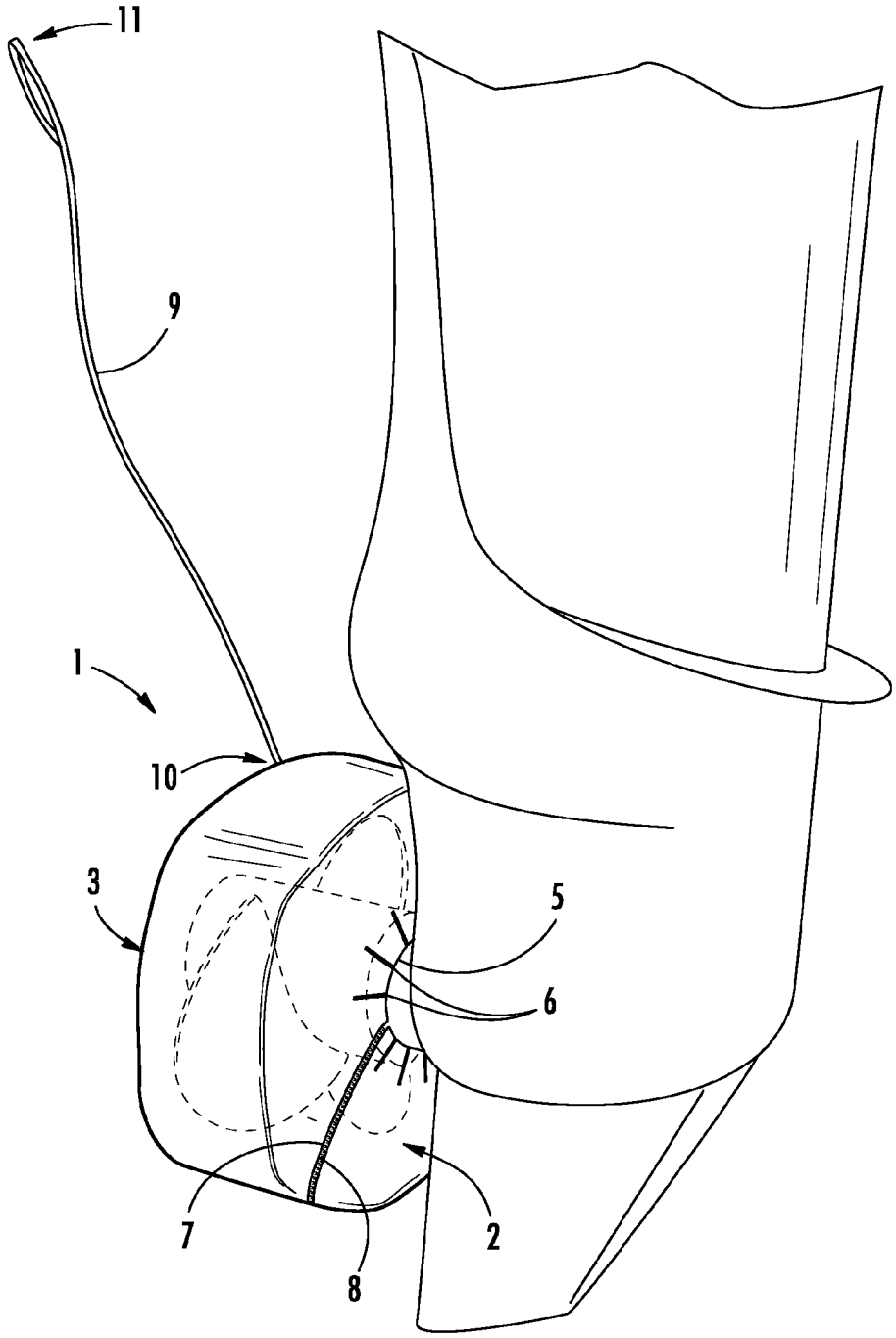
FIG. 1A is a perspective view of the novel protective cover encasing an inboard/outboard marine propeller.

In the following detailed description of the preferred embodiments, reference is made to the accompanying drawings, which form a part hereof, and within which are shown by way of illustrating specific embodiments by which the invention may be practiced. It is to be understood that other embodiments may be utilized and structural changes may be made without departing from the scope of the invention.

Terms

As used herein, the term "layer", refers to any material capable of forming a protective housing. Examples include, but are not limited to, vinyl or canvas.

As used herein, the term "force", refers to any pulling or pushing motion that can remotely disengage the attaching element within the scope of this invention. Examples include, but are not limited to, a vertical or horizontal force or a diagonal force applied by a user.

As used herein, the term "remotely", refers to any distance above a body of water surrounding a propeller, in which a user may facilitate removal of the protective cover.

As used herein, the term "slit", refers to any division in a layer of material where an opening is created to allow the central opening located on the first layer of the protective cover, access to a marine propeller hub or shaft.

As used herein, the term "attaching element", refers to any self-latching method a user could perform to secure or to release the protective cover layers or slit components in an open or closed configuration as described within this invention. Examples include, but are not limited to, a series of hook and loop fasteners or snaps or buttons.

As used herein, the term "outer perimeter", refers to the outer dimension of the protective cover. Examples include, but are not limited to, a square shape or a circle shape, or any other shape associated with encasing a marine propeller.

As used herein, the term "outer most extent", refers to any edge, rim, or side of the first layer or second layer of the protective cover.

As used herein, the term "length of material", refers to any amount of release apparatus great enough in magnitude, to enable a user to remotely remove the protective cover as described in this invention. Examples include, but are not limited to, rope, chain, cord, or rod.

As used herein, the term "release apparatus", refers to any material great enough in length to which a force is applied by a user, whereby the protective cover is remotely removed as described in this invention. Examples include, but are not limited to rope, chain, cord, or rod.

As used herein, the term "waterproof material", refers to any water impermeable and pliable component of the protective cover. Some waterproof materials have breathability allowing for water vapor to pass through. Examples include, but are not limited to, canvas or vinyl.

As used herein, the term "central opening", refers to any orifice on the first layer of the protective cover, capable of accepting a marine propeller hub or shaft.

As used herein, the term "reliefs", refers to any cut or separation of the material surrounding the central opening, allowing the circumference of the central opening to expand and fit different sized propeller hubs or shafts.

Figure 1B:
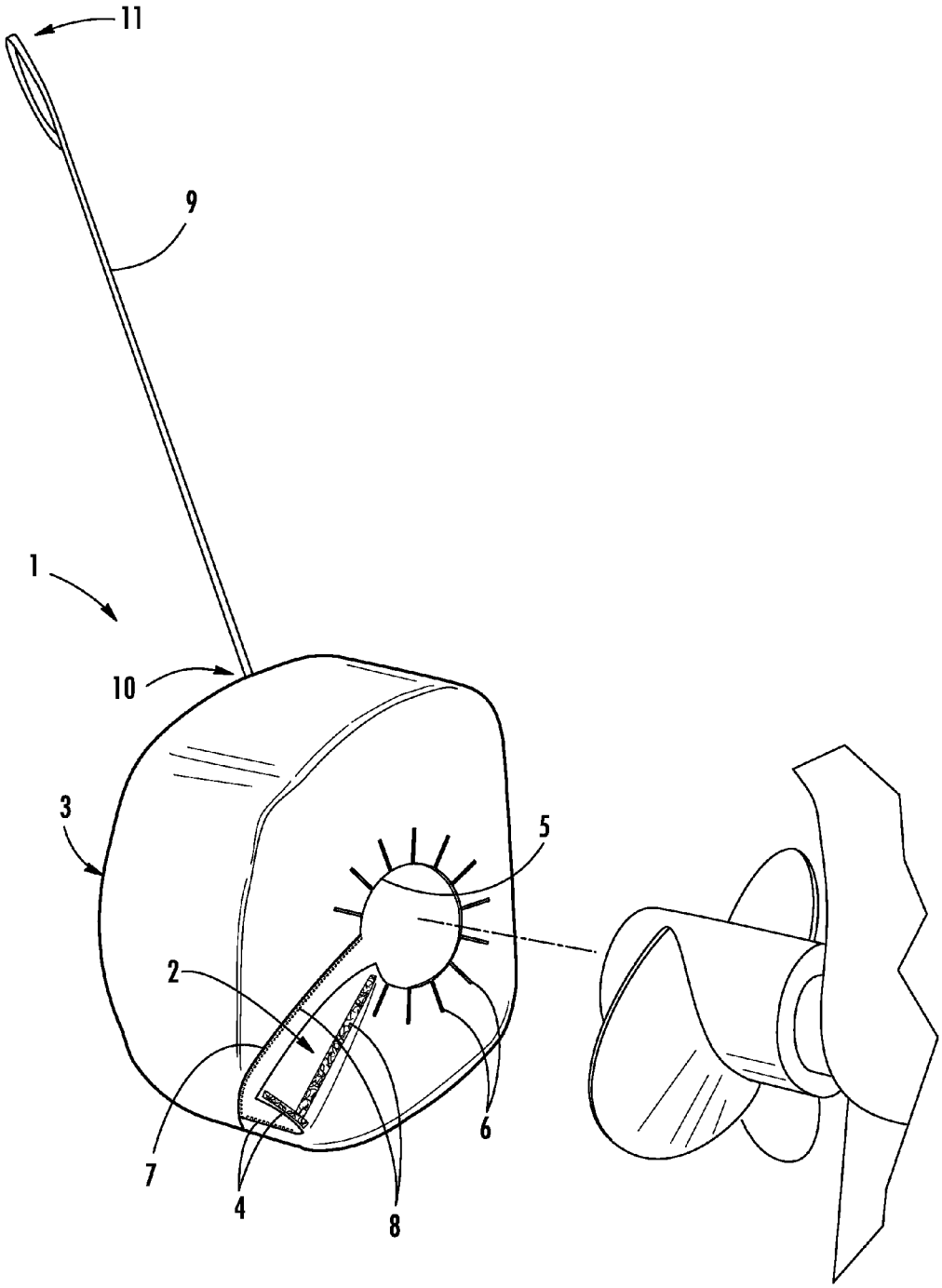
FIG. 1B is an exploded perspective inside view of the protective cover's first layer and second layer components.

Referring now to FIGS. 1A and 1B, it will there be seen that the reference numeral 1 denotes an illustrative embodiment of the novel protective cover as a whole. Novel protective cover 1 is made by first layer 2 located opposite of second layer 3. First layer 2 and second layer 3 are made of a flexible waterproof material including, but not limited to canvas or vinyl. Protective cover 1 is not limited to the preferred embodiment as shown and may encompass any size or shape to encase a marine propeller.

In FIG. 1B, attaching element 4 is located on the interior surface of the first layer 2 and second layer 3. Attaching element 4 is adapted to couple first layer 2 to second layer 3. Although the preferred embodiment is a series of hook and loop fasteners, the scope of this invention should not be limited to, but should also encompass any self-latching methods such as snaps or buttons.

Figure 2:
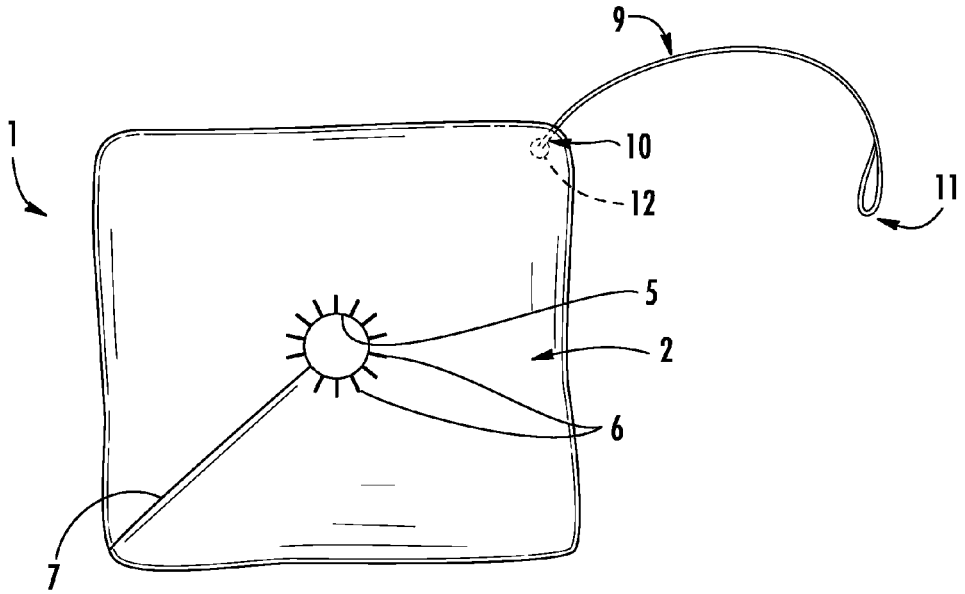
FIG. 2 is a front view of the protective cover first layer.

FIGS. 1A and 1B further depict a central opening 5 located on first layer 2 and is adapted to receive a marine propeller hub or shaft. In the embodiment of FIG. 2 a plurality of reliefs 6 is located on the first surface 2 around the circumference of central opening 5. When a marine propeller hub or shaft is received by central opening 5, the plurality of reliefs 6 accommodates various sized marine propeller hubs or shafts.

In FIGS. 1A and 1B, slit 7 is located on first surface 2 and transverses from central opening 5 to the outer most extent of first surface 2. Attaching element 8 is located on the exterior and interior surfaces of first layer 2. Attaching element 8 allows a user to open or close slit 7, allowing the protective cover 1 access to a marine propeller hub or shaft.

Figure 3:
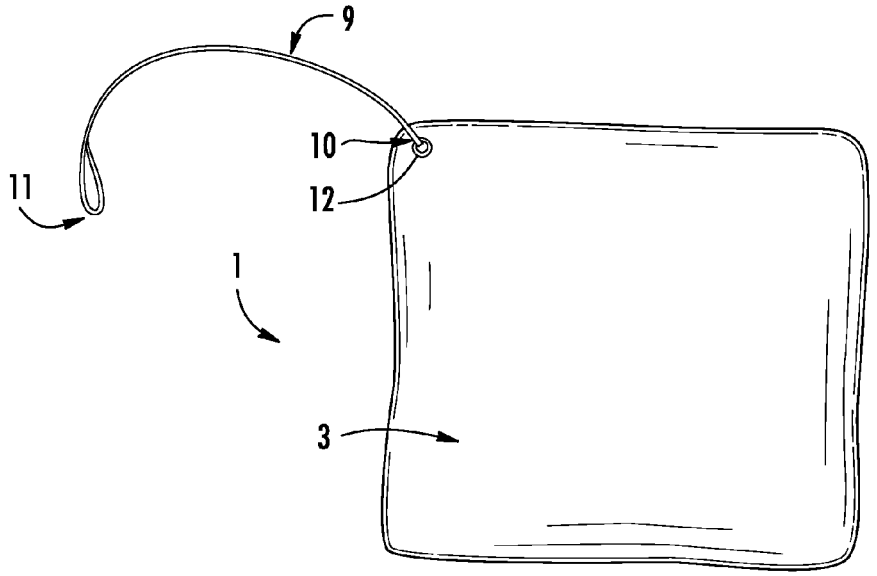
FIG. 3 is a rear view of the protective cover second layer.

In FIGS. 2 and 3, release apparatus 9 is connected to protective cover 1 at end 10. The force of a user is applied to end 11 of release apparatus 9 to remotely remove protective cover 1 from a marine propeller. Remote removal eliminates the need for a user to perform any maneuvers associated with removing protective cover 1 at the marine propeller. In one embodiment, release apparatus 9 is a length of material being of a length great enough to facilitate removal of protective cover 1 from a distance above the surrounding water of the marine propeller.

The embodiment of FIGS. 2 and 3 depict release apparatus 9 adapted to be released from a distance above the surrounding water of a marine propeller by the force of a user being applied to end 11. This force uncouples attaching element 8 from split 7 and attaching element 4 from first layer 2 and second layer 3, whereby protective cover 1 will be open to expose the marine propeller, as best depicted in FIG. 1B. Once protective cover 1 is in an open configuration, any force such as the pushing or pulling of release apparatus 9 will allow protective cover 1 to be remotely removed from a marine propeller.

FIG. 2 illustrates the front perspective view of the preferred embodiment of a protective cover 1. Central opening 5 is located on first layer 2. A plurality of reliefs 6 surrounds the circumference of central opening 5. Slit 7 transverses from central opening 5 to the outer most extent of first layer 2. Release apparatus 9 is connected to protective cover 1 at end 10. This embodiment shows end 10 being connected to a reinforcing eyelet 12, in which release apparatus 9 is tied onto. An alternate embodiment of this invention is that end 10 of release apparatus 9 is connected by any other attaching methods such as being sewn. The force of a user is applied to end 11 of release apparatus 9 to remotely remove protective cover 1 from a marine propeller.

FIG. 3 illustrates the rear view protective cover 1 components of a preferred embodiment. Second layer 3 is a waterproof material including, but not limited to, canvas or vinyl. Release apparatus 9 is connected to protective cover 1 at end 10. This embodiment shows end 10 being connected to a reinforcing eyelet 12, in which release apparatus 9 is tied onto. The force of a user is applied to end 11 of release apparatus 9 to remotely remove protective cover 1 from a marine propeller.

Figure 4:
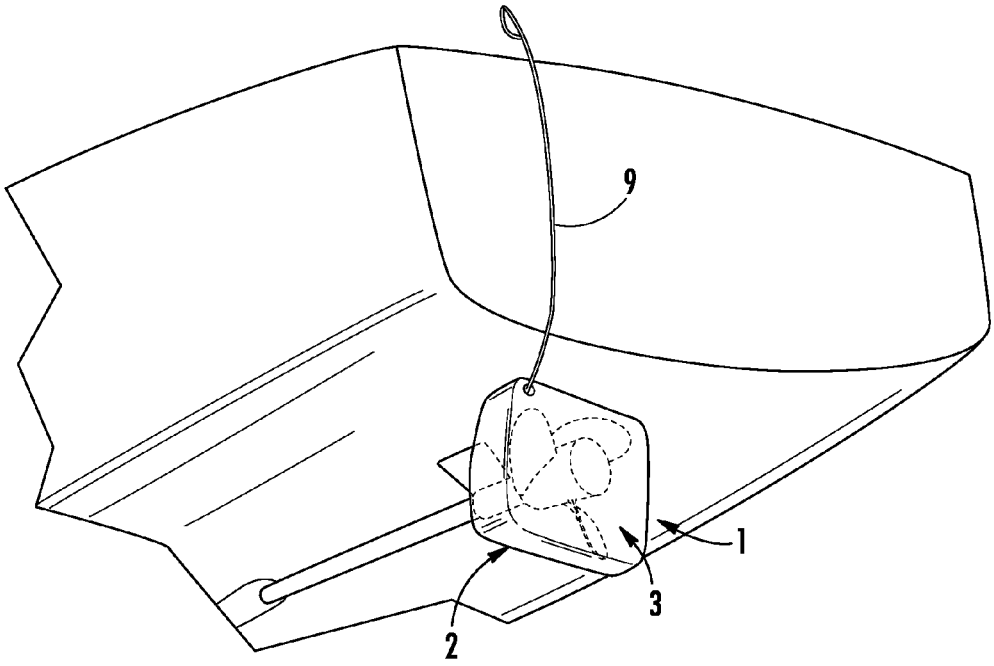
FIG. 4 is a perspective view of a protective cover encasing an inboard marine propeller.

An embodiment of FIG. 4 further depicts protective cover 1 installed on an inboard propeller. First layer 2 and second layer 3 are located underwater. Release apparatus 9 is located and operated by a user above the waterline.

Figure 5:
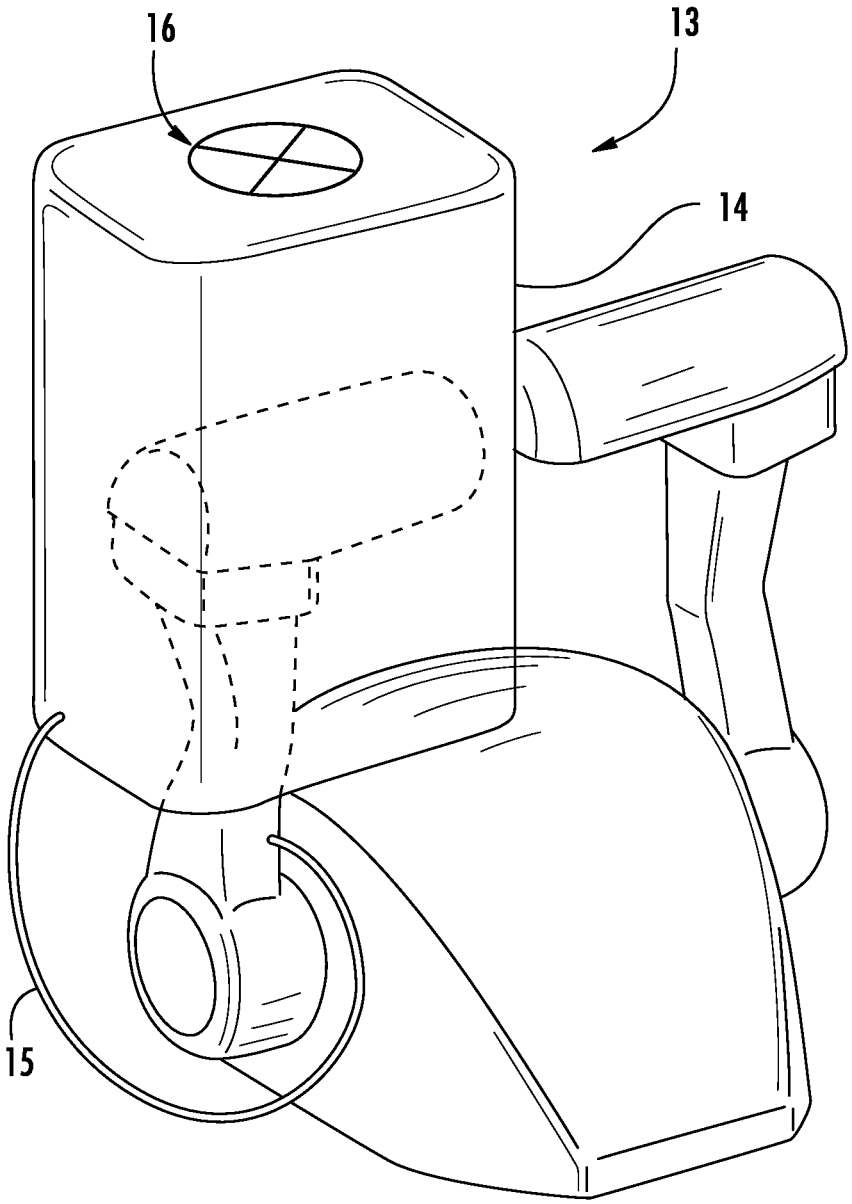
FIG. 5 is a perspective view of a shift control warning attachment.

FIG. 5 illustrates a shift control warning attachment 13 installed on a shift control. Sleeve 14 covers the shift control. A piece of material 15 connects sleeve 14 to the shift control. Warning label 16 is located on the surface of sleeve 14 in a visible location where a user can easily view the warning, remove protective cover from propeller, and then engage the propeller drive.

In all of these exemplary configurations, it should be understood that the specific attaching elements disclosed herein may take many forms that are well-known in the marine propeller cover art and all of such alternative forms are within the scope of this invention. For example, snaps, magnets, or a series of hooks and loops may be used to form the needed coupling connections.

It will thus be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

Now that the invention has been described,

The invention claimed is:

1. A protective cover kit for a marine propeller, comprising:

a propeller cover comprising:

a first layer and a second layer, said first layer located opposite said second layer;

at least one attaching element mounted on said first layer and said second layer;

a central opening thereon said first layer;

a slit thereon said first layer, said slit having at least one attaching element;

said attaching element being releasable when a force is applied;

and a release apparatus connected to said protective cover, facilitating remote removal of said protective cover by a user when said force is applied to said release apparatus;

a shift control warning attachment.

2. The protective cover kit for a marine propeller of claim 1, wherein said first layer and said second layer are substantially the same outer perimeter.

3. The protective cover kit for a marine propeller of claim 1, wherein said first layer and said second layer are coupled by at least one attaching element of a series of hooks and loops.

4. The protective cover kit for a marine propeller of claim 1, wherein said first layer and said second layer are constructed of a waterproof material.

5. The protective cover kit for a marine propeller of claim 1, wherein said protective cover is attached to a length of material, said length of material being of a length great enough to facilitate remote removal of said protective cover.

6. The protective cover kit for a marine propeller of claim 5, wherein a force is applied to an end of said length of material.

7. The protective cover kit for a marine propeller of claim 1, wherein said slit transverses from said central opening to the outer most extent of said first layer.

8. The protective cover kit for a marine propeller of claim 7, wherein said slit has at least one attaching element of a series of hooks and loops.

9. The protective cover kit for a marine propeller of claim 1, wherein said central opening has a plurality of reliefs radiating from its circumference.

10. The protective cover kit for a marine propeller of claim 1, wherein said shift control warning attachment has a configuration warning a user to remove said protective cover from propeller.

11. A protective cover kit for a marine propeller, comprising:

a propeller cover comprising:

a shape capable of substantially encasing a marine propeller, said shape having a first layer located opposite a second layer;

at least one attaching element mounted on said first layer and said second layer;

a central opening thereon said first layer;

a slit thereon said first layer, said slit having at least one attaching element;

said attaching element being releasable when a force is applied;

and a release apparatus connected to said protective cover, said protective cover configured to be remotely removed from said marine propeller by a user wherein said force is applied to said release apparatus;

a shift control warning attachment.

12. The protective cover kit for a marine propeller of claim 11, wherein said first layer and said second layer are coupled by at least one attaching element of a series of hooks and loops.

13. The protective cover kit for a marine propeller of claim 11, wherein said first layer and said second layer are constructed of a waterproof material.

14. The protective cover kit for a marine propeller of claim 11, wherein said central opening has a plurality of reliefs radiating from its circumference.

15. The protective cover kit for a marine propeller of claim 11, wherein said slit transverses from said central opening to the outer most extent of said first layer.

16. The protective cover kit for a marine propeller of claim 15, wherein said slit has at least one attaching element of a series of hooks and loops.

17. The protective cover kit for a marine propeller of claim 11, wherein said protective cover is attached to a length of material, said length of material being of a length great enough to facilitate remote removal of said protective cover.

18. The protective cover kit for a marine propeller of claim 17, wherein a force is applied to an end of said length of material.

19. The protective cover kit for a marine propeller of claim 11, wherein said shift control warning attachment has a configuration warning a user to remove said protective cover from propeller.

20. A method of facilitating remote removal using a protective cover kit for a marine propeller, comprising the steps of:

placing said protective cover around said marine propeller;

connecting attaching element of said protective cover;

installing a warning attachment to a shift control lever;

locating an end of a release apparatus remotely from said protective cover, wherein the said release apparatus is adapted to separate attaching element of said protective cover by a user;

and a user applying a force to an end of said release apparatus, whereby said propeller cover is removed from said marine propeller.

* * * * *